US008091880B2

(12) United States Patent
Honegger

(10) Patent No.: US 8,091,880 B2
(45) Date of Patent: Jan. 10, 2012

(54) DEVICE FOR FITTING PRINTED PRODUCTS WITH INSERTS

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 177 days.

(21) Appl. No.: 12/519,112

(22) PCT Filed: Oct. 11, 2007

(86) PCT No.: PCT/CH2007/000502

§ 371 (c)(1),
(2), (4) Date: Jun. 12, 2009

(87) PCT Pub. No.: WO2008/080236

PCT Pub. Date: Jul. 10, 2008

(65) Prior Publication Data

US 2009/0322009 A1 Dec. 31, 2009

(30) Foreign Application Priority Data

Dec. 29, 2006 (CH) ..... 2132/06

(51) Int. Cl.
*B65H 39/06* (2006.01)

(52) U.S. Cl. ..... 270/52.25; 270/52.14; 270/52.16; 270/52.19; 270/52.21; 270/52.22; 270/52.23

(58) Field of Classification Search ..... 270/52.14, 270/52.16, 52.19, 52.21, 52.22, 52.23, 52.25
See application file for complete search history.

(56) References Cited

U.S. PATENT DOCUMENTS

| | | | | |
|---|---|---|---|---|
| 3,951,399 | A | 4/1976 | Reist et al. | |
| 3,955,667 | A | 5/1976 | Muller et al. | |
| 4,058,202 | A | 11/1977 | Reist et al. | |
| 4,416,448 | A * | 11/1983 | Meier | 270/52.2 |
| 4,496,941 | A | 1/1985 | Clatworthy | |
| 4,709,910 | A | 12/1987 | Honegger | |

(Continued)

FOREIGN PATENT DOCUMENTS

CH 669 944 4/1989

OTHER PUBLICATIONS

International Search Report dated Jan. 17, 2007, for PCT/CH2007/000502, filed Oct. 11, 2007.

(Continued)

*Primary Examiner* — Leslie A Nicholson, III
(74) *Attorney, Agent, or Firm* — Alston & Bird LLP

(57) ABSTRACT

The device has successively disposed receiving elements (14). These are formed by a channel-like base (42) and a wall (44) trailing as viewed in circumferential direction (U). The circumferential path (24) extends in the working section (38) at an incline such that the printed products (18) fed by means of the first conveyor (10) come to rest in the system at the base (42) and plane against the wall (44). A sliding body (60) is associated with each receiving element (14), the sliding body displacing the fed printed products (18) along the wall (44) of the receiving section (46) in the insertion section (48) by abutting the same. The printed products (18) are opened, wherein the second product part (18") is placed behind the hold-open element (50), which is disposed on the forward receiving element (14). Inserts (20) are added to the printed products (18) by means of a second conveyor (12).

15 Claims, 4 Drawing Sheets

U.S. PATENT DOCUMENTS 4,729,554 A * 3/1988 Honegger ..... 270/52.3
4,743,005 A 5/1988 Reist
4,867,429 A * 9/1989 Infanger ..... 270/52.2
5,104,108 A 4/1992 Honegger
5,112,036 A 5/1992 Hatt
5,265,915 A 11/1993 Seidel et al.
5,441,245 A 8/1995 Fluckiger
5,443,250 A 8/1995 Gosslinghoff

OTHER PUBLICATIONS

English translation of International Preliminary Report on Patentability, dated Aug. 4, 2009, for PCT/CH2007/000502, filed Oct. 11, 2007.

* cited by examiner

III
10
12
14
16
18
18'
18"
20
22
24,28
26
30
32
34
36
38
40
42
44
46
48
50
52
54
56
58
60
62
64
66
68
70
72
74
76
S
W
Z
U

DEVICE FOR FITTING PRINTED PRODUCTS WITH INSERTS

The present invention relates to a device for fitting multiple-sheet printed products with inserts according to the preamble of patent claim 1.

A device of this type is known, for example, from patent specifications CH 669 944 and U.S. Pat. No. 4,743,005. It has a plurality of identical receiving elements. These are of pocket-like design, are open at the top and have a leading wall and a trailing wall. They are intended to receive in each case one printed product and are fastened in a continuous row on drive mechanisms which circulate endlessly transversely to the opening of the receiving elements. The pockets run one after the other past feed stations for printed products and the inserts, each pocket being provided with a mechanism for opening the printed products. The base of each pocket is formed by a receiving channel with end walls which can be displaced in a controlled manner, transversely to the direction of circulation of the pocket, from a first end position into a second end position, each pocket containing an opening wedge which cannot be moved relative to the pocket and by way of which the printed product carried along by the receiving channel is opened as it is displaced from the first end position into the second end position.

A first feed conveyor feeds the printed product to each pocket, the printed product coming into abutment against the receiving channel located in the first end position and with surface contact against the leading wall. When the receiving channel is displaced, together with the printed product, into the second end position, a triangular extension of a directing plate causes the one, overfold-containing part of the printed product to be lifted off from the part which butts against the leading wall and to be directed behind a directing plate, by way of which the printed product which has been opened in this way can be kept open. With the receiving channel located in the second end position, further feed conveyors introduce inserts into the opened printed product. The receiving channel is then moved back again into the first end position, in which case the printed product closes. A removal conveyor designed as a gripper conveyor is then used to grip and convey away the printed products fitted with inserts.

It is an object of the present invention to develop the device of the type in question such that it is of more straightforward construction and also makes it possible to process printed products with a low level of inherent stability.

This object is achieved by a device as claimed in patent claim 1.

In the operating portion, the circulatory path of the receiving elements slopes such that the printed products come into abutment with surface contact against the trailing wall of the receiving elements and by way of a side edge against the channel-like base. The trailing wall here is preferably inclined such that the printed products, rather than being located in a vertical or more or less vertical, upright position, are located in more of a lying position, in which case even printed products with a low level of inherent stability are not buckled under their own weight. It is thus possible to dispense with a leading wall of the receiving element. The channel-like base is fixed to the trailing wall and extends, together with the trailing wall, over a receiving portion and an insertion portion. Since, in the case of the device according to the invention, the printed products need be moved only in a displacement direction from the receiving portion in the direction of the insertion portion, and not counter to this displacement direction, the relevant displacement means are designed as pushing mechanisms.

Preferred embodiments of the device according to the invention are specified in the dependent patent claims.

The invention will be explained in more detail with reference to exemplary embodiments which are illustrated in the drawing and in which, purely schematically:

Figure 6:
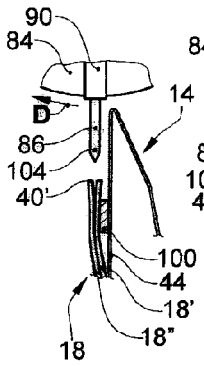
FIG. 6 shows the same view of part of a receiving element, this time with a centrally folded printed product arranged in it and with part of an opening subassembly with an air nozzle.
Figure 6A:
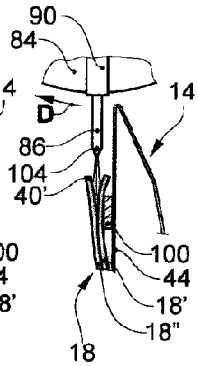
Figure 3:
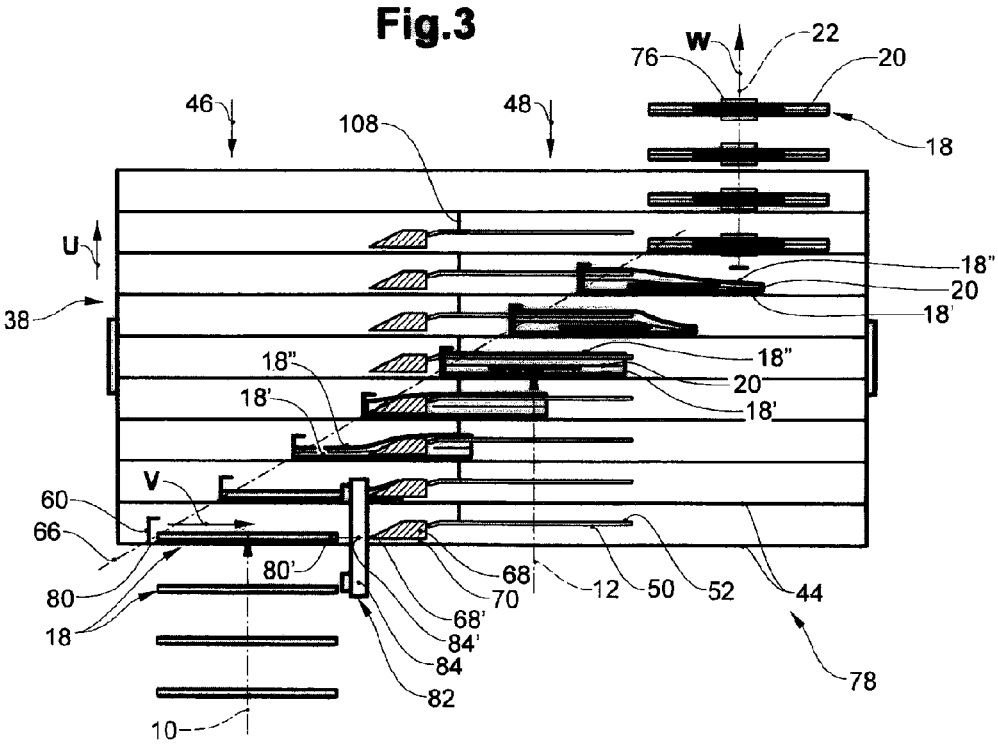
FIG. 3 shows a plan view of the device according to FIG. 1 as seen in the direction of the arrow III from FIG. 1.
Figure 8:
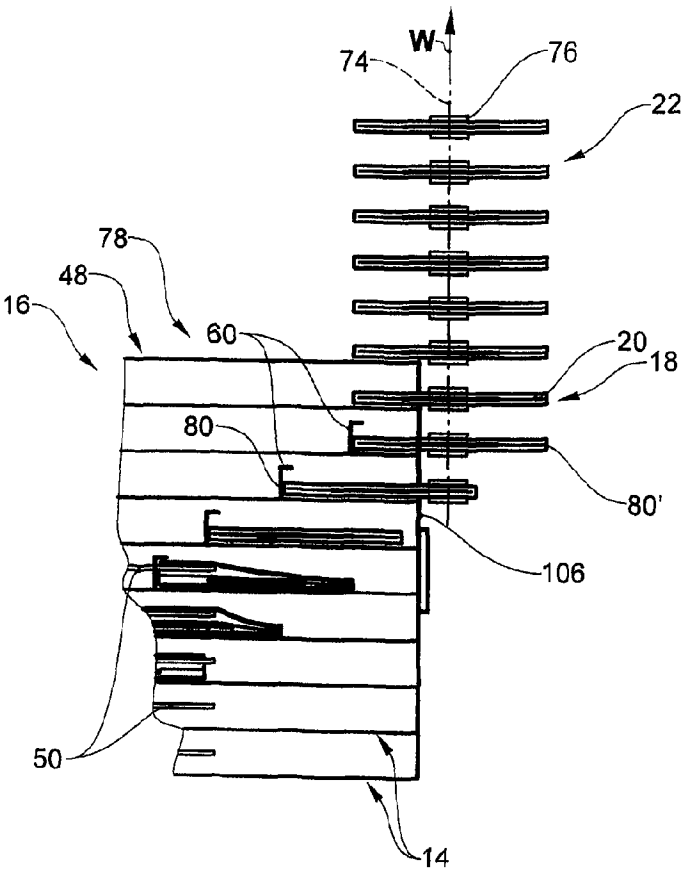
Figure 7:
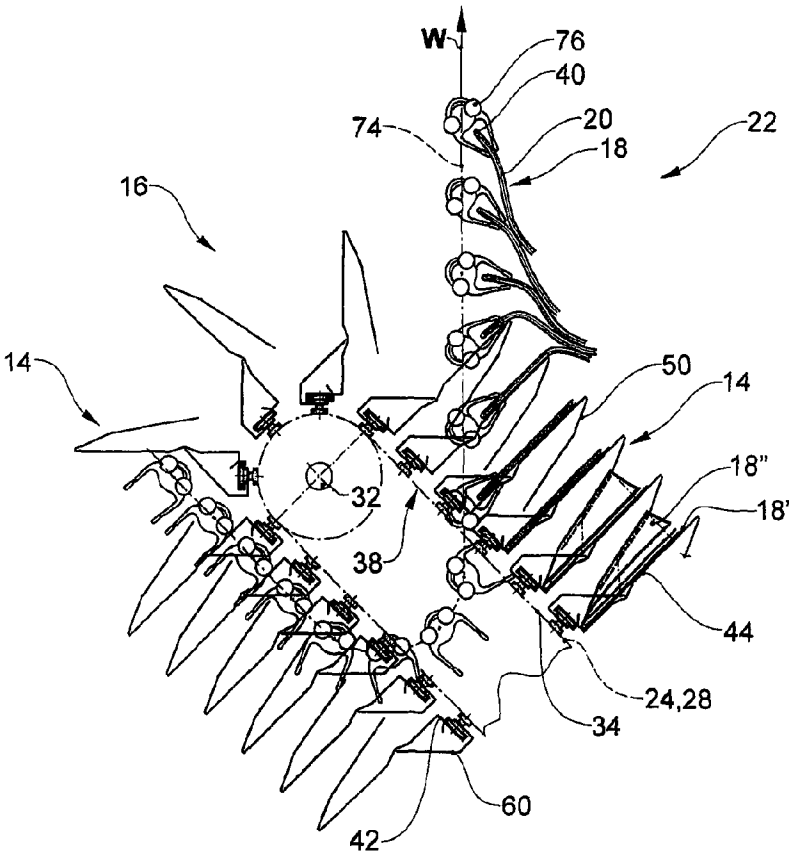
Figure 9:
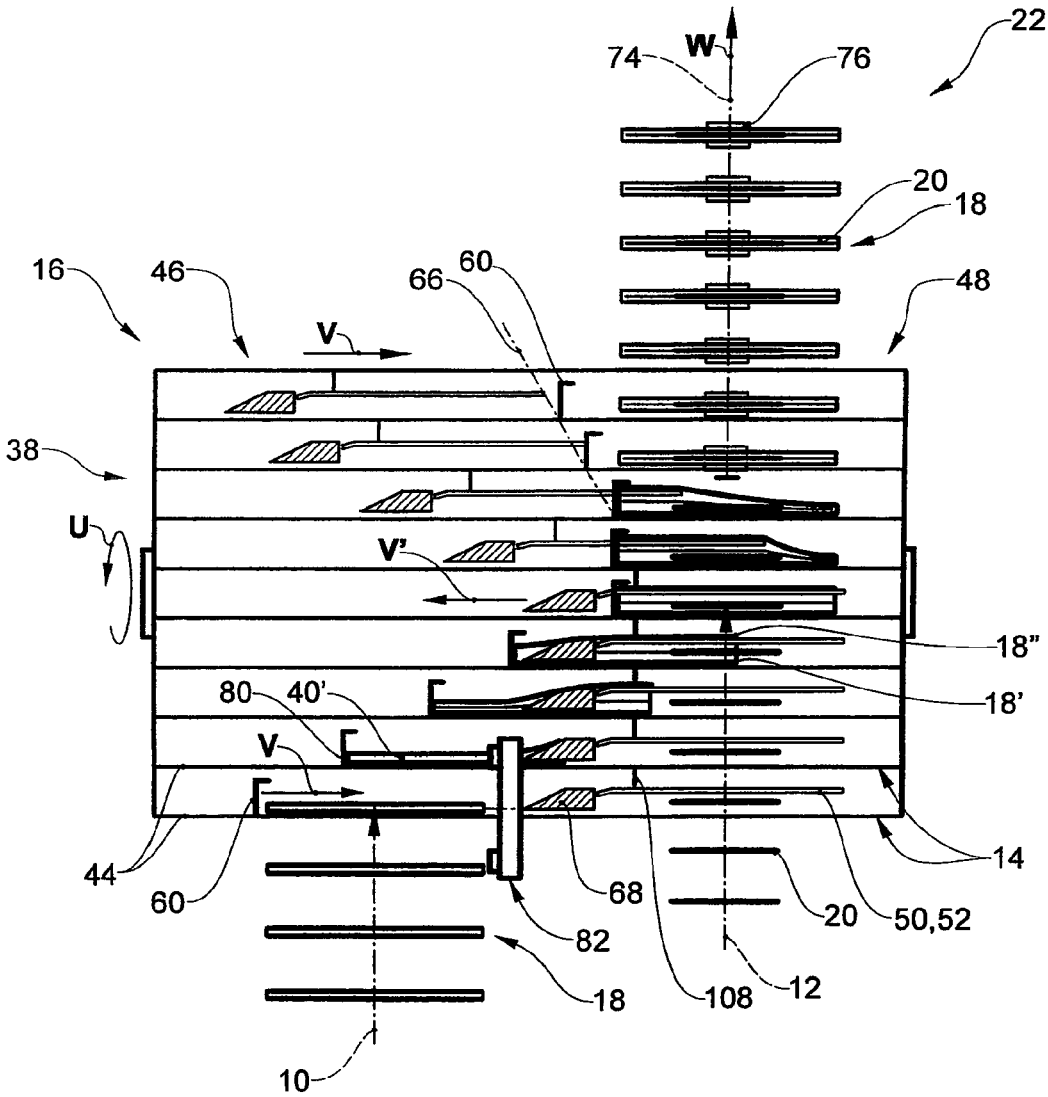

FIG. 6*a* shows the embodiment according to FIG. 6 shortly after the release of the air jet in order to open the printed product partially by means of the air jet;

FIG. 7 shows a side view of part of a device according to a second embodiment of the invention, in the case of which the printed products fitted with an insert are gripped at their side edge butting against the channel-like base, and then conveyed away, by means of a removal conveyor designed as a gripper conveyor;

FIG. 8 shows, in the same view as FIG. 3, part of the embodiment of the device according to FIG. 7 with the removal conveyor running to the side of the movement path of the receiving elements; and FIG. 9 shows, in the same view as FIG. 3, a third embodiment of the device according to the invention, this time with a removal conveyor by way of which the printed products fitted with an insert are gripped in the insertion portion and conveyed away.

Figures 1, 2:
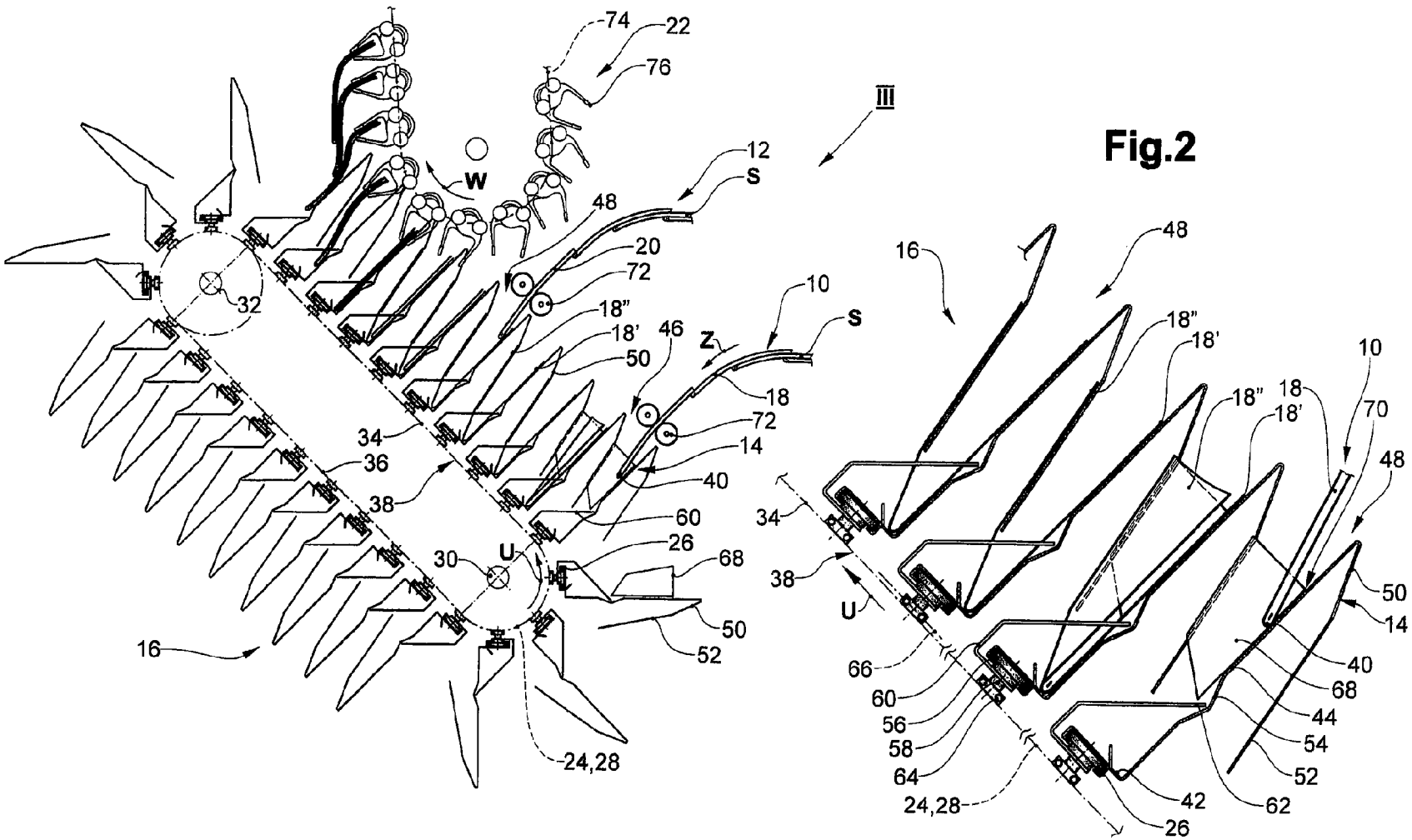
FIG. 1 shows a view of a device according to the invention, as seen in the direction following the route of the printed products.
FIG. 2 shows, on an enlarged scale in relation to FIG. 1, part of the device shown in FIG. 1, with four receiving elements.

The device according to the invention which is shown in FIG. 1 has a first feed conveyor 10 and a second feed conveyor 12, which are intended to feed printed products 18 and inserts 20, respectively, to the receiving elements 14 of a processing conveyor 16, and a removal conveyor 22, by way of which the printed products 18 respectively provided with an insert 20 can be received from the processing conveyor 16 and are transported away.

The processing conveyor 16 has a plurality of identically designed receiving elements 14 which are driven in the direction of circulation U along a continuous circulatory path 24 and are arranged one behind the other and at right angles to the circulatory path 24. Each receiving element 14 is fastened on a cross-sectionally C-shaped profiled carrier 26 which has its two ends guided via guide rollers—as disclosed, for example, in CH 669 944 and U.S. Pat. No. 4,743,005—in continuous rails (not shown). Furthermore, the profiled carriers 26 are fastened, at their two ends, on a respective drive mechanism 28, for example a chain which is driven in circulation. The chain-dotted line indicates, on the one hand, the circulatory path 24 and, on the other hand, the drive mechanism 28. The latter is guided, at the upstream end of the processing conveyor 16, around a deflecting wheel 30, which is indicated by way of its axle, and, at the downstream end of the processing conveyor 16, around a drive wheel 32, which is indicated by way of its axle. The drive wheel 32 is motor-driven continuously in a known manner. Between the deflecting wheel 30 and the drive wheel 32, a top, active strand 34 and a bottom, return strand 36 run rectilinearly. The active strand 34 defines an operating portion 38, in which the rectilinear circulatory path 24 runs at a constant slope of approximately 45°. This slope may be smaller or greater, but it is always selected such that the printed products 18 fed come into abutment by way of their leading side edge 40, as seen in the feed direction Z, against a channel-like base 42, and with surface contact against a trailing wall 44, of the receiving elements 14.

As can be seen from FIGS. 1 and 2, the base 42 and the trailing wall 44 are produced integrally from a piece of metal plate by bending. The base 42 is fastened on the profiled carrier 26 and extends, together with the trailing wall 44, along the profiled carrier 26 over at least more or less the entire length thereof. As seen in the longitudinal direction of the receiving element 14, the latter has a receiving portion 46 and an insertion portion 48, see also FIG. 3 in this respect. In the insertion portion 48, the metal plate which forms the base 42 and the wall 44 has a tongue which forms a holding-open element 50 for the following receiving element 14, as seen in the direction of circulation U. For this purpose, the above-mentioned tongue is angled rearward in relation to the direction of circulation U at the top end of the wall 44, which is located opposite the base 42, such that a holding-open portion 52 of the holding-open element 50 is spaced apart from the wall 44, more or less parallel thereto. In the region of the operating portion 38, a gap is present between the base 44 of the receiving element 14 and the associated holding-open element 50, although the latter is arranged on the preceding receiving element 14, and this gap is of sufficient magnitude in order for the opened printed product 18 to be able to run through, with its second product part 18" lifted off from the first product part 18' butting against the wall 44, without being damaged or undergoing inadmissible bending.

Furthermore, the wall 44 has, at a distance from the base 42 and running parallel to the latter and the profiled carrier 26, a cross-sectionally V-shaped bead 54 which projects in the direction of the holding-open element, i.e. counter to the direction of circulation (U). As measured from the base 42, the bead 54 is located approximately a third of the way up the height of the wall 44. The wall 44 forms a single plane above and beneath the bead 54.

Mounted in a displaceable manner in the C-shaped profiled carrier 26, which is open toward the bottom in the operating portion 38, is a carriage 56—the latter may, of course, also be formed differently, for example by a pair of rollers—which engages through the opening in the profiled carrier 26 by way of a stub 58. Fastened on this stub 58 is a pushing mechanism 60 which is produced, for example, from a rod, engages with play around the profiled carrier 26 on the side directed away from the base 42 and has its free end 62 engaging with play in the bead 54.

A roller 64 is mounted in a freely rotatable manner at the free end of the stub 58, and this roller is guided. in a fixed guide track 66. All the rollers 64 are controlled by the same guide track 66 such that, during movement of the profiled carriers 26 and thus receiving elements 14 along the circulatory path 24, the pushing mechanisms 60 execute a movement in the longitudinal direction of the receiving elements 14, as will be explained at a later stage in the text in conjunction with FIG. 3.

Furthermore, each wall 44, and thus each receiving element 14, is assigned an opening wedge 68. The latter is located, as seen in the longitudinal direction of the receiving elements 14, between the receiving portion 46 and the insertion portion 48 and is arranged to precede the relevant wall 44, as seen in the direction of circulation U, and to be parallel thereto, a gap 70 being formed in the process. The opening wedge 68 is fastened on the wall 44, for example by means of a retaining bracket, such that a printed product 18 fed to the receiving element 14 can be pushed through without obstruction between the base 42 and the retaining bracket.

The first feed conveyor 10 and the second feed conveyor 12, and possibly further feed conveyors, may be designed, in a known manner, as belt conveyors. Since the printed products 18 and inserts 20 are fed from above, the belt conveyors preferably form a conveying gap which, as seen in the feed direction Z, terminates at a distance from a pair of accelerating rollers 72 (see FIG. 1). If the printed products 18 and insert 20 are fed in an imbricated formation S, the above-mentioned distance is selected such that the printed product 18, or the insert 20, which is to be introduced into a receiving element 14 by means of the pair of accelerating rollers 72 can be separated from the imbricated stream S. It can also be seen from FIG. 1 that the feed direction Z, at the end of the feed conveyors 10, 12, runs at least more or less parallel to the trailing walls 44 in the operating portion 38.

The first feed conveyor 10 is intended, for each receiving element 14 running past it, to introduce a printed product 18 into the receiving portion 46. Correspondingly, the second feed conveyor 12 is intended, for each receiving element 14 running past it, to feed an insert 20 - or a plurality of inserts 20—to the insertion portion 48. Since the printed products 18 displaced from the receiving portion 46 into the insertion portion 48 have been opened, the inserts 20 thus pass into the opened printed product 18 between the first product part 18' and the second product part 18".

The receiving elements 14 do not have a leading wall preceding the trailing wall 44. This can be seen to particularly good effect in FIG. 1 in the region of the deflecting wheel 30 and drive wheel 32, where the receiving elements 14 fan out as a result of the deflection.

As seen in the direction of circulation U, the first feed conveyor 10 is located at the start of the operating portion 38, the second feed conveyor 12 is located in a central region of the operating portion 38, and the removal conveyor 22 is located at the end of the operating portion 38. In the present example, the removal conveyor is designed as a gripper conveyor and has individually controllable grippers 76 spaced apart one behind the other on a continuous conveying mechanism 74 which is driven in circulation in the removal direction W. These grippers each coincide with a receiving element 14, grip the printed product 18 fitted with at least one insert 20, and convey it away.

FIG. 3 shows in a simplified state, and partly in section, nine receiving elements 14 located in the operating portion 38. These receiving elements are all designed identically to those shown in FIGS. 1 and 2 and described above, the only exception being that the holding-open mechanism 50, rather than being designed as an angled tongue, is formed by a holding-open plate which is fastened on the wall 44 by means of a carrying arm 108. Each receiving element 14 has a receiving portion 46, an insertion portion 48 downstream of the receiving portion, as seen in the displacement direction V, and a removal portion 78 downstream, in turn, of the insertion portion, as seen in the displacement direction V. The respective opening wedge 68 is located between the receiving portion 46 and insertion portion 48. The gap 70 between the opening wedge 68 and the relevant wall 44 can be seen to particularly good effect in this illustration. The opening wedge 68 has its rectilinear opening edge 68' directed counter to the displacement direction V; the opening edge 68' has its top end projecting counter to the displacement direction V in relation to its bottom end.

The respective opening wedge 68 is followed in the displacement direction V by the holding-open element 50, which is fastened on the trailing wall 44 of the respectively preceding receiving element 14. The leading surface of the holding-open portion 52 of the holding-open element 50, as seen in the direction of circulation U, is aligned with the corresponding surface of the opening wedge 68, in which case the product part 18" can slide without obstruction along the relevant surfaces. That end region of the holding-open element 50 which is directed toward the opening wedge 68 is angled slightly, and set back in relation to the abovementioned surface.

FIG. 3 also shows the sliding mechanisms 60, which are moved in the displacement direction V, along the guide track 66, which is indicated by dashed lines, in the operating portion 38. The sliding mechanisms 66, which are produced from a rod, form, as seen in plan view, an L such that, as seen in the displacement direction V, the respectively trailing edge 80 of the printed products 18 is arrested between the wall 44 and the sliding mechanism 60.

The arrow 10 symbolizes the first feed conveyor, which has fed a printed product 18 to the rearmost receiving element 14 in FIG. 3, wherein three further printed products 18 are indicated and these are to be fed to the three next-following receiving elements 14. The second feed conveyor 12 is likewise symbolized by an arrow. Of the removal conveyor 22, four grippers 76 are shown, wherein the rearmost of these grippers has gripped a printed product 18 still arranged in the relevant receiving element 14, and fitted with an insert 22, in order to convey it away. The front three grippers 76 shown have received printed products 18, already provided with inserts 20, from the corresponding receiving elements 14.

Arranged in a stationary manner at the start of the operating portion 38 is an opening subassembly 82, of which the construction and functioning will be described at a later stage in the text in conjunction with FIGS. 4-6. The opening subassembly is arranged between the receiving portion 46 and the opening wedge 68, as seen in the displacement direction V, and has the task of partially opening the printed product 18 moving past it in each case in the direction of circulation U and displacement direction V, for which purpose the second production part 18" is lifted off from the first product part 18" in certain regions, in which case, during further displacement in the displacement direction V, the first product part 18' is introduced into the gap 70 in a state in which it butts against the relevant wall 44 and the other, second product part 18", under the action of the opening wedge 68, is lifted right off from the product part 18' and pushed behind the holding-open portion 52 of the holding-open element 50.

The device which is shown in FIGS. 1-3 operates as follows: the first feed conveyor 10 is used to feed a multiple-sheet printed product 18 to each receiving element 14 in its receiving portion 46. This printed product comes into abutment by way of its leading side edge 40 against the channel-like base 42 and with surface contact against the trailing wall 44. As a result of the receiving element 14 moving further in the direction of circulation U, the sliding mechanism 60 is moved forward in the displacement direction V, in which case it comes into abutment against the trailing edge 80 of the printed product 18, as seen in the displacement direction V, and pushes this printed product in the direction of the opening wedge 68. The opening subassembly 82 opens the printed product 18 on a preliminary basis in the corner region of the leading edge 80' and top side edge 40' such that the opening wedge 68, which projects further at the top than at the bottom counter to the displacement direction V, penetrates into the pre-opened printed product 18 and, as the printed product 18 is displaced further, directs the product part 18", which is lifted off from the product part 18' butting against the wall 44, behind the holding-open element 50.

In the insertion portion 48, where the printed product 18 which has been opened in this way is held open, at least one insert 20 is introduced into this printed product. As the receiving elements 14 are moved further in the direction of circulation U, the relevant printed product 18 is pushed from the insertion portion 48 into the removal portion 78, as a result of which the second product part 18" falls gradually onto the first product part 18' and/or the insert 20 until it is fully released from the holding-open element 50, and then the printed product 18 is completely closed. As soon as the printed product 18 fitted with the insert 20 is located in the removal portion 78, the relevant pushing mechanism 60 is moved back counter to the displacement direction V, and the insert-carrying printed product 18 is then gripped at the top side edge 40' by means of the gripper 76 and conveyed away.

Figure 4:
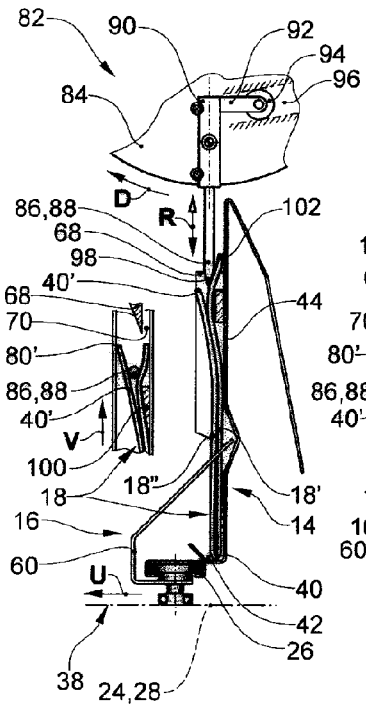
FIG. 4 shows a view of a receiving element and of part of an opening subassembly during opening of a printed product using an opening blade, the wall-side part of the printed product being formed with an overfold, and the small illustration on the left-hand side shows the same situation in plan view.
Figure 5:
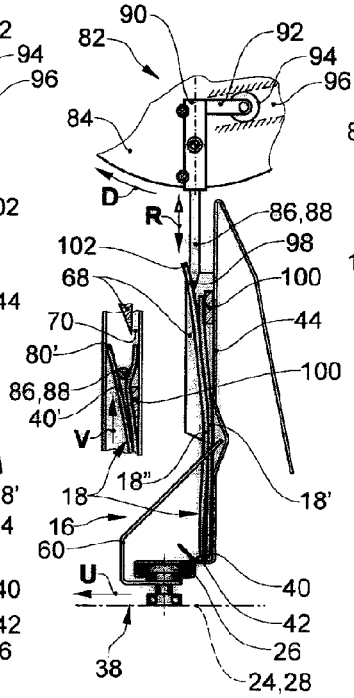
FIG. 5 shows, in the same view as FIG. 4, the same device during opening of a printed product in which that part of the printed product which is spaced apart from the wall is provided with an overfold, and the small illustration on the left-hand side shows the same situation in plan view.

FIGS. 4 and 5 each show part of the opening subassembly 82 and also a receiving element 14 fitted with a multiple-sheet printed product 18. The opening subassembly has a carrying element 84, which in the present case is in the form of a disk and is driven continuously, in the direction of rotation D, about its axis of rotation 84' (see also FIG. 3). The carrying element has two diametrically opposite opening mechanisms 86 in the form of an opening blade 88. The two opening blades 88 (of which in each case only one is shown in FIGS. 4 and 5) are each mounted in a radially displaceable manner in a guide element 90 fastened on the carrying element 84. In the radially inward direction, the opening blade 88 is fixed to an actuating arm 92, at the free end of which a control roller 94 is mounted in a freely rotatable manner. The control roller 94 is guided in a control guide track 96 running around the axis 84' and, depending on the rotary position of the carrying element 84, it displaces the opening mechanism 86 in the radial direction, as is indicated by the double arrow R. The shank-like opening blade 88 is tapered in a wedge-like manner at its radially outer, free end such that its penetrating edge 98 runs parallel to the wall 44 of the receiving element 14.

A deflecting wedge 100 is fastened on the wall 44 upstream of the opening wedge 68, as seen in the displacement direction V. By means of this deflecting wedge, the printed product 18 butting against the base 42 and with surface contact against the wall 44 can be lifted off from the wall 44, by way of an end region adjacent to the top side edge 40', during displacement in the displacement direction V. As can be gathered, in particular, from the plan view in FIG. 4, the opening mechanism 86 is located at a short distance downstream of the deflecting wedge 100, as seen in the displacement direction V.

In FIG. 4, the printed product 18 is folded eccentrically and has its fold (side edge 40) butting against the base and has its first product part 18', which contains an overfold 102, butting with surface contact against the trailing wall 44, wherein the overfold 102, which projects beyond the second product part 18", is lifted off from the wall 44, as a result of the displacement by means of the deflecting wedge 100, in an end region adjacent to the leading edge 80'. The opening blade 88, however, acts on the overfold 102 on the side of the latter which is directed away from the wall 44, and angles the overfold 102 back in the direction of the wall 44 above the deflecting wedge 100. As a result, the second product part 18" is lifted off from the first product part 18' in the corner region of the leading edge 80' and top side edge 40'. As the printed product 18 is displaced further in the displacement direction V, the opening wedge 68 engages in the folded printed product 18, beginning in this corner region, and opens it to the full extent along the center during further movement.

The printed product 18 which is shown in FIG. 5 is likewise folded eccentrically, although in this case the overfold 102 is formed on the second product part 18". The first product part 18', as a result of the displacement in the displacement direction V, has its leading, top end region butting against the deflecting wedge 100, and the opening blade 88 acts on the overfold 102 on the side of the latter which is directed toward the wall 44 and thus lifts the second product parts 18" off from the first product part 18' 30 in an end region adjacent to the top side edge 40' and leading edge 80'. During further displacement in the displacement direction V, the opening wedge 68 penetrates into the printed product 18 which has thus partially been opened along the center in order to open the printed product 18 to the full extent.

The rotation of the carrying element 84 is coordinated with the processing conveyor 16 such that an opening mechanism 86 coincides with each receiving element 14. The opening blade 88 here is controlled via the control guide track 96 such that it can act on the overfold 102, but does not come into contact with the receiving elements 14. That embodiment of the opening subassembly 82 which is shown in FIGS. 4 and 5 can also be used to open centrally folded or other multiple-sheet printed products 18, although it is no longer imperative for the opening to take place along the center. In this case, the two product parts 18' and 18" terminate at a distance above the deflecting wedge 100.

An opening subassembly as is shown in FIGS. 6 and 6*a* is also suitable for opening multiple-sheet printed products 18 which, in particular, do not contain any overfold. These two figures each show only the top end region of a receiving element 14, which is designed in a manner precisely identical to those shown in FIGS. 4 and 5. Two opening mechanisms 86 are arranged diametrically opposite one another on the carrying element 84 which, once again, is circular and is driven in rotation, in the direction of rotation D, about its axis of rotation 84'. These opening mechanisms, once again, are of shank-like design, but have an internal air channel and at their free end, rather than having an insertion edge 98, are designed as an air nozzle 104. As a result of being mounted in the guide element 90, and by means of the control guide track 96, the air nozzle 104 is activated such that it is positioned at a defined, relatively short distance from the top side edge 40' of the relevant printed product 18, as FIG. 6 shows. In order for the printed product 18 to be opened in the corner region defined by the top side edge 40' and leading edge 80', the air nozzle 104 is then subjected to the action of compressed air, as FIG. 6*a* shows. During further displacement in the displacement direction V, the opening wedge 68 then penetrates between the product parts 18' and 18", which are partially lifted off from one another by means of the air jet. As soon as this is the case, the feed of compressed air can be interrupted.

In the case of an embodiment which is shown in FIGS. 7 and 8, the processing conveyor 16 is designed in a manner identical to that which is shown in FIGS. 1-3 and described above, but the pushing mechanisms 60 are moved further in the displacement direction V in the removal portion 78 such that the printed products 18 fitted with inserts 20 are pushed out beyond the end 106 of the receiving element 14, as can be gathered from FIG. 8. Whereas in the embodiment which is shown in FIGS. 1-3 the receiving elements 14 have a cutout in their top end region in the removal portion 78, in order to make it possible for the printed products 18 fitted with inserts 20 to be gripped by means of the grippers 76, this is no longer necessary in the case of the embodiment according to FIGS. 7 and 8.

The removal conveyor 22, once again, is designed as a gripper conveyor and has grippers 76 arranged one behind the other on a continuous conveying mechanism 74 which is driven in circulation in the removal direction W. The removal conveyor 22 is arranged to the side of the processing conveyor 16 such that, in order to receive, and transport away, the printed products 18 fitted with inserts 20, the grippers 76, at the end of the operating portion 38, run vertically upward from the bottom at a small distance from the end 106 of the receiving elements 14. The speed of the conveying mechanism 74 and the spacing of the grippers 76 are coordinated with the processing conveyor 16 such that a gripper 76 coincides with each receiving element 14, and thus with each printed product 20 pushed out beyond the end 106 of the receiving element 14. The relevant opened gripper 76 is controlled such that the printed product 18 which is to be gripped is enclosed by it, and prevented from tilting, from beneath and then the gripper closes and conveys the printed product 18 away in a state in which it is held at its side edge 40. Once the printed product 18 has been received, the gripper 76 can be pivoted such that the printed products 18 pass into an imbricated hanging position. The inserts here are also held in a clamped state by the gripper 76.

A third embodiment of the device according to the invention is shown in FIG. 9. However, it is only the differences in relation to the embodiment which is shown in FIGS. 1-3 which will be discussed hereinbelow. The processing conveyor 16, once again, has receiving elements 14 with a channel-like base and a trailing wall 44. However, these are of shorter design, as seen in the longitudinal direction, since, rather than having any removal portion 78, they only have a receiving portion 46 and an insertion portion 48. The opening wedge 68 assigned to each receiving element 14 is preferably fastened on the relevant holding-open element 50, which in turn is borne by the preceding receiving element 14. The holding-open element 50 is fastened on a carrying arm 108 which is mounted such that it can be displaced linearly, parallel to the base 42, in a rail on the rear side of the wall 44 of the preceding receiving element 14. The carrying arm 108 is spaced apart from the base 42 such that the second product part 18" can be pushed through therebetween in the displacement direction V without any contact.

The holding-open element 50, together with the opening wedge 68, is controlled, for example by means of a further guide track, such that, upon entry into the operating portion 38, they are located in the insertion portion 48. This position is maintained at least as far as that location of the circulatory path 24 at which the second feed conveyor 12 discharges the inserts 20 to the receiving elements 14. During further movement in the direction of circulation U, the holding-open element 50 and the opening wedge 68 are then moved back into the receiving portion 46 in the direction V' counter to the displacement direction V.

The guide track 66 controls the movement of the pushing mechanisms 60 such that, once a printed product 18 has been fed into the receiving portion 46 of a receiving element 14, they come into abutment against the trailing edge 80 of the relevant printed product 18 and push the latter in the displacement direction V, during further movement in the direction of circulation U, into the insertion portion 48. The respective printed product 18 here, as has been described above in conjunction with FIGS. 1-6, is opened on a preliminary basis by means of the opening subassembly 82 and then opened to the full extent by means of the opening wedge 68. At the feed location for the inserts 20, which is provided by the second feed conveyor 12, the printed product 18, once again, is opened to the full extent, wherein the first product part 18' butts against the wall 44 of the receiving element and the second product part 18" butts against the holding-open element 50, which is arranged on the preceding receiving element 14. Once the pushing mechanism 60 has reached the insertion portion 48, the guide track 66 runs in the direction of circulation U such that the printed product 18 together with the insert 20 fed to it is held in the stationary state in the displacement direction V by way of the pushing mechanism 60, while the holding-open element 50 and the opening wedge 68 are displaced back into the receiving portion 46 in the direction of the arrow V'. By virtue of being displaced back in this way, the holding-open element 50 releases the second product part 18", which results in the printed product 18 being closed. The guide track 66 then runs such that, as soon as the holding-open element 50 has been moved out of the insertion portion 48, the pushing mechanism 60 is likewise moved back into the receiving portion 46 counter to the displacement direction V.

The removal conveyor 22 is designed in a manner identical to that in the embodiment according to FIGS. 1-3, although in this case, at the end of the operating portion 38, the printed products 18 fitted with inserts 20 are gripped by its grippers 76, in the insertion portion 48, from above and then conveyed away. In order to make it possible for the printed products 18 to be gripped, the walls 44 of the receiving elements 14, in the insertion portion 48, have a corresponding cutout in their top end region.

The first feed conveyor 10 and the second feed conveyor 12 may be designed as gripper conveyors. It is also conceivable for one or more further feed conveyors to be provided downstream of the second feed conveyor 12 in order for different inserts 20 to be fed to the printed products 18.

Of course, the second feed conveyor 12 can be used to feed a single insert 20, or a plurality of inserts 20 at the same time, to each printed product 18.

Multiple-sheet printed products 18 are to be understood as those which have at least two sheets, it being possible for these to be formed by the two parts of a large folded sheet. It is also conceivable for the printed products 18 to comprise a folded part in which a further part is arranged. The printed product may also be formed by a stack of sheets. The insert may be formed in one or more pieces. It may be of the same format as the printed product or of a smaller format. The insert need not be a printed product; it may also be formed, for example, by a CD or the like.

The removal conveyor 22 may also be designed differently. It is thus conceivable, in particular in the case of the embodiment according to FIGS. 7 and 8, to use a belt conveyor.

The opening subassembly 82 may likewise be designed differently to the manner shown in FIGS. 4, 5, 6 and 6*a* and described above. It is thus conceivable to use an opening subassembly according to EP 0 574 741 A in a device according to the invention. It is further conceivable for the opening mechanisms 86, rather than running along a circular movement path, to circulate along an elongate movement path. Translatory movement back and forth is also conceivable.

In respect of printed products being opened by means of air nozzles 104, reference is made to EP 0 577 964 A. The latter document also shows that, in this case, a deflecting wedge 100 could be dispensed with.

If a change is made to the format of the printed products which are to be processed, the most which is required of the processing conveyor 16 is for the opening subassembly to be set and adjusted.

In the operating portion, the wall 44 of a receiving element 14 and the associated holding-open element 50, which is arranged on the preceding receiving element 14, run at a small acute angle of approximately 10°, that is to say more or less parallel to one another, the end edge of the base 42 being located approximately in the plane defined by the holding-open element 50. This angle may be selected to be smaller or larger, but it is always selected to be small enough to ensure that printed products with a very low level of inherent stability do not buckle, as they butt against the holding-open element 50, as a result of the dead weight of the second product part 18".

The invention claimed is:

1. A device for fitting multiple-sheet printed products with inserts comprising:

a plurality of identically designed receiving elements which are driven in a direction of circulation along a continuous circulatory path, wherein the circulatory path has an operating portion;

a first feed conveyor;

at least one second feed conveyor arranged downstream of the first feed conveyor and intended to feed an insert to the opened printed products moved into the insertion portion; and a removal conveyor arranged downstream of the at least one second feed conveyor, at the end of the operating portion, and intended to convey away the printed products provided with the insert, wherein the receiving elements are arranged one behind the other and transversely to the circulatory path and each receiving element has a channel-like base and a trailing wall;

the trailing wall extends over a receiving portion and an insertion portion of the respective receiving element;

the receiving elements are each assigned a displacement means by way of which a printed product fed to the receiving portion of the relevant receiving element by means of the first feed conveyor can be displaced in a displacement direction into the insertion portion;

each receiving element being assigned, in its insertion portion, a holding-open element for holding open the opened printed product, wherein the operating portion is arranged along a slope of the circulatory path such that the printed products fed butt against the base and with surface contact against the trailing wall of the receiving elements, wherein the base is fixed to the trailing wall, and the displacement means have a pushing mechanism for advancing the printed products, the pushing mechanism pushing on the trailing edge of the relevant printed product, as seen in the displacement direction.

2. The device as claimed in claim 1, wherein the trailing wall of each receiving element has arranged on it the holding-open element assigned to the next-following receiving element.

3. The device as claimed in claim 1, wherein the holding-open element, in the operating portion, runs substantially parallel to the trailing wall.

4. The device as claimed in claim 1, wherein each receiving element has, between the receiving portion and the insertion portion, an opening wedge which, on the one hand, is spaced apart from the trailing wall and, on the other hand, in the operating portion, is substantially aligned with the relevant holding-open element.

5. The device as claimed in claim 4, wherein the removal conveyor is intended to grip and convey away the printed products which are fitted with the insert and, in the insertion portion, butt against the base and against the trailing wall, and the holding-open element and the opening wedge are moved away out of the insertion portion downstream of the at least one second feed conveyor and upstream of the removal conveyor.

6. The device as claimed in claim 1, wherein an opening subassembly is arranged in downstream of the first feed conveyor and upstream of the at least one second feed conveyor and by way of which printed products transported past it can be opened partially.

7. The device as claimed in claim 6, wherein the opening subassembly has opening mechanisms, which circulate along a continuous movement path and are controlled such that an opening mechanism coincides with each receiving element in order to open the relevant printed product partially.

8. The device as claimed in claim 7, wherein the opening mechanisms comprise opening blades or air nozzles.

9. The device as claimed in claim 6, wherein the opening subassembly opens the printed products transported past it in the region of their leading edge, as seen in the displacement direction, and of their side edge which is remote from the base and runs parallel thereto.

10. The device as claimed in claim 1, wherein each receiving element has a removal portion which follows the insertion portion, as seen in the displacement direction, and into which the printed products provided with the insert are pushed by means of the pushing mechanism, and the removal conveyor is intended to grip and convey away the printed products with insert which, in the removal portion, butt against the base and against the trailing wall.

11. The device as claimed in claim 1, wherein the printed products fitted with the insert are pushed out beyond the trailing wall in the displacement direction by the pushing mechanisms until in each case at least part of the printed product is exposed, and the removal conveyor runs to the side of the movement path of the receiving elements in order to receive the printed products and convey them away.

12. The device as claimed in claim 1, wherein the removal conveyor is intended to grip and convey away the printed products which are fitted with the insert and, in the insertion portion, butt against the base and against the trailing wall, and the holding-open element is moved away out of the insertion portion downstream of the at least one second feed conveyor and upstream of the removal conveyor.

13. The device as claimed in claim 1, wherein the removal conveyor has grippers.

14. The device as claimed in claim 1, wherein the holding-open element, in the operating portion, runs more or less parallel to the trailing wall and each receiving element has, between the receiving portion and the insertion portion, an opening wedge which, on the one hand, is spaced apart from the trailing wall and, on the other hand, in the operating portion, is substantially aligned with the relevant holding-open element.

15. The device as claimed in claim 14, wherein an opening subassembly is arranged in a stationary manner downstream of the first feed conveyor and upstream of the at least one second feed conveyor and by way of which printed products transported past it can be opened partially.

* * * * *